United States Patent [19]

Kusche et al.

[11] 4,244,332

[45] Jan. 13, 1981

[54] INDUCTION SYSTEM FOR A V-TYPE TWO-CYCLE ENGINE

[76] Inventors: David W. Kusche, 1521 W. 5th Ave., Oshkosh, Wis. 54901; Keith M. Gagnier, 5379 Highway G, Winneconne, Wis. 54986

[21] Appl. No.: 64,151

[22] Filed: Aug. 6, 1979

[51] Int. Cl.[3] ..... F02B 75/18

[52] U.S. Cl. ..... 123/59 B; 123/52 M; 123/52 MV; 123/59 PC; 123/55 R; 123/73 R

[58] Field of Search ..... 123/59 PC, 59 B, 73 R, 123/73 A, 55 R, 55 US, 52 M, 52 MV

[56] References Cited

U.S. PATENT DOCUMENTS

| | | | |
|---|---|---|---|
| 3,166,054 | 1/1965 | Conover | 123/55 R |
| 3,269,374 | 8/1966 | Conover | 123/59 B |
| 3,592,173 | 7/1971 | Frehe et al. | 123/59 B X |
| 3,759,493 | 9/1973 | Blanchard et al. | 123/73 R X |
| 4,092,958 | 6/1978 | Hale | 123/73 A X |

*Primary Examiner*—Wendell E. Burns
*Attorney, Agent, or Firm*—O. T. Sessions

[57] ABSTRACT

An induction system for a V-type two-cycle crankcase compression engine (10) with a vertical crankshaft (14) uses two-barrel carburetors (17) with the barrels (19) horizontally adjacent to supply air-fuel mixture to the engine (10). A crankcase compartment (15) is provided for each cylinder (11), the compartments (15) being in a vertical row and surrounding the crankshaft (14). A carburetor adapter or inlet manifold (18) connects each carburetor barrel (19) to one of the crankcase compartments (15).

9 Claims, 5 Drawing Figures

INDUCTION SYSTEM FOR A V-TYPE TWO-CYCLE ENGINE

DESCRIPTION

1. Technical Field

This invention relates to a carburetion system for an internal combustion engine and particularly to the air-fuel induction system for a two-cycle engine.

2. Background Art

Prior V-block two-cycle engines have used a variety of induction system configurations with the goal of increasing the engine's power by increasing the air flow to the engine. An example of the prior art is U.S. Pat. No. 3,166,054 showing an induction system supplying air-fuel mixture to six cylinders from three carburetor barrels.

DISCLOSURE OF INVENTION

An induction system for a multi-cylinder two-cycle engine with a vertical crankshaft has separate crankcase compartments for each cylinder, arranged in a vertical row. The charge inlet ports for the crankcase compartments are arranged in a vertical row and have a rectangular cross section. A die cast carburetor adapter connects each of the inlet ports to one of the barrels of a carburetor. Each carburetor is mounted with its two barrels horizontally adjacent.

BEST MODE FOR CARRYING OUT THE INVENTION

Figure 1:
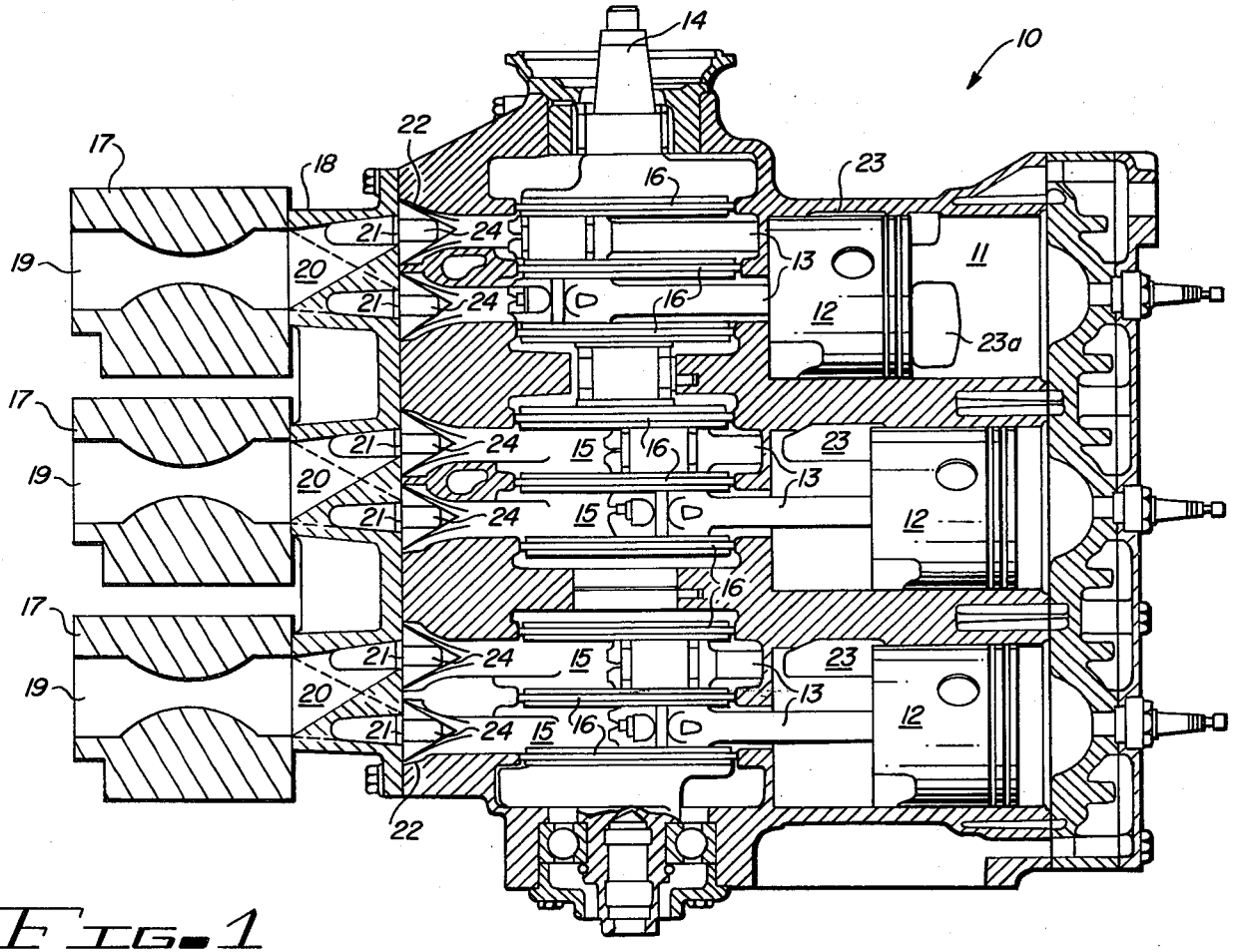
FIG. 1 is an elevational view in section of an engine incorporating the feature of the invention.

FIG. 1 is an elevational view in section of a two-cycle V-6 engine 10 particularly designed for use in an outboard motor. The engine 10 has cylinders 11 within which piston 12 reciprocate. The pistons 12 are connected by connecting rods 13 to crankshaft 14. As is conventional in outboard motors the engine 10 is operated with the crankshaft 14 a generally vertical orientation. A separate crankcase compartment 15 is provided for each of the six cylinders 11, with the compartments 15 separated from each other by disks and sealrings 16 on the crankshaft 14. Though only one bank of three cylinders 11 is shown in FIG. 1, all six crankcase compartments 15 are shown.

The crankcase compartments are subjected to compression and expansion as the pistons 12 reciprocate, thereby providing a pumping action. Air-fuel mixture is supplied to the crankcase compartments 15 by three two-barrel carburetors 17, mounted on engine 10 by a carburetor adapter plate 18. Each carburetor barrel 19 is connected to supply air-fuel mixture to one of the crankcase compartments 15 by a passage 20 through the carburetor adapter plate 18. A reed valve assembly 21 is provided in each of the crankcase inlet openings 22 to assure one way flow of the air-fuel mixture from the carburetors 17 to the crankcase compartments 15, on the piston upstroke. In the crankcase compartments 15 the air-fuel charge is compressed on the downstroke of the associated piston 12 and transferred to the combustion chambers when the transfer ports 23 are uncovered by the pistons 12. The air-fuel charge is then compressed in the cylinder 11, ignited, expanded to give a power stroke, and exhausted through the exhaust port 23*a* to complete a conventional two-stroke cycle.

The engine induction system is arranged to increase the engine's horsepower output by providing additional flow of air-fuel mixture to the engine. Three two-barrel carburetors 17 are mounted in a vertical row with their barrels 19 forming two vertical rows to allow mounting of larger carburetors than would be possible if the barrels were arranged in a single row. To accommodate the increased carburetor capacity, horizontal crankcase inlet openings 22 are provided to allow the use of extended length reed valve blocks 24 with increased capacity, and the totally die castable manifold 18 provides separate passages 20 from each carburetorbarrel 18 to its corresponding reed block 24.

Figure 2:
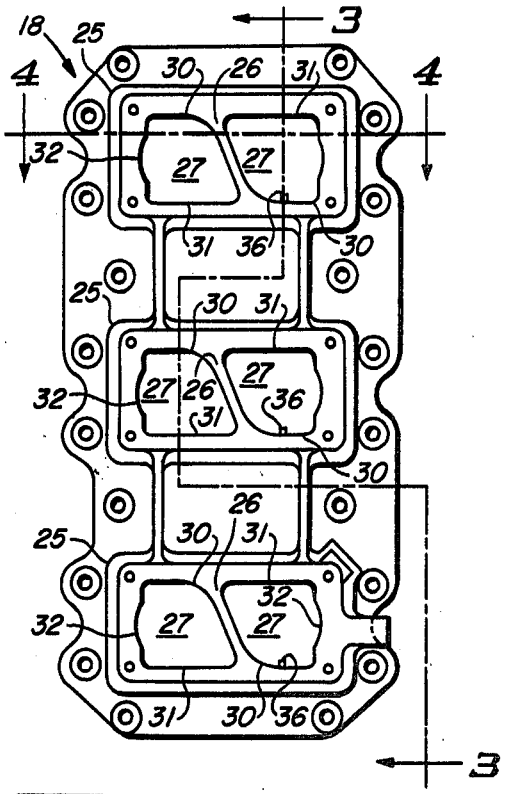
FIG. 2 is a view of the inlet side of the carburetor adapter plate.
Figure 3:
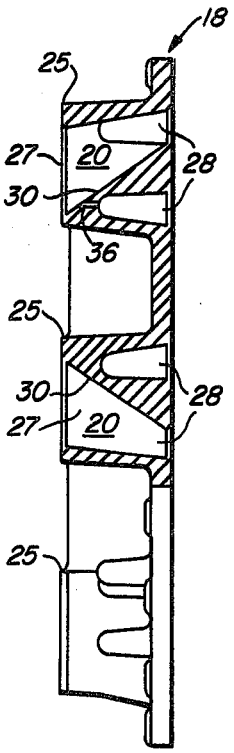
FIG. 3 is a sectional view taken along line 3—3 of FIG. 2.
Figure 4:
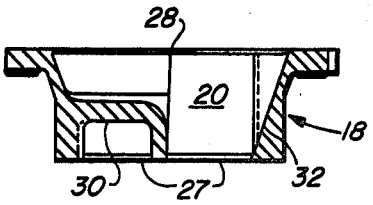
FIG. 4 is a sectional view taken along line 4—4 of FIG. 2.
Figure 5:
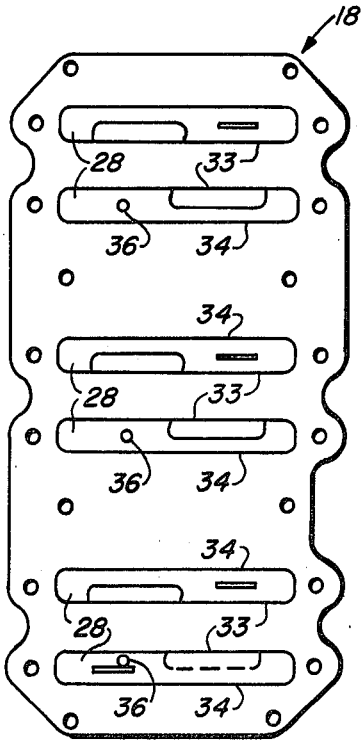
FIG. 5 is a view of the engine side of the carburetor adapter plate.

As shown in FIG. 2 the manifold 18 has three generally rectangular inlet sections 25, each of which is divided into two passages 20. At the intake or carburetor side of the manifold 18 the passages 20 are formed by a diagonal wall 26 dividing each of the rectangular sections 25 into two horizontally adjacent symmetrical intake openings 27, large enough to circumscribe the discharge openings of the round carburetor barrels 19. FIGS. 3 and 4 show the shape of the passages 20 as they make the transition from the horizontally adjacent intake openings 27 to the vertically adjacent discharge openings 28, most clearly shown in FIG. 5.

A problem is encountered in providing a smooth flow transition from the horizontally adjacent pair of carburetor barrels 19 to the corresponding vertically adjacent pair of rectangular crankcase inlet openings 22. An optimum, essentially linear, transition from one openings to the other is not possible since the two passages in a pair would intersect.

The inventors have devised a near optimum solution for this problem by providing an intake manifold 18 with diagonal walls 26 between the circular discharge opening of the carburetor barrels, shown in broken lines in FIG. 2. The inlet section of each adapter passage 20 is thus formed by a diagonal wall 26, a short wall 30, a long wall 31, and an end wall 32. The short wall 30 is planar, extending at an angle from the intake openings 27 to the center wall 33 of the discharge openings 28, while the diagonal wall 26 extends inwardly, perpendicular to the plane of the intake openings 27, to intersect the short wall 30. The long walls 31 extend in a plane between the intake openings 27 and the outside walls 34 of the discharge openings 28. A portion 35 of the long walls 31 underlies the short wall 30 of the mating passage to extend passage 20 the full length of the discharge opening 28. This arrangement provides an intake manifold 18 which is die castable, with only two die pulls, in opposite directions.

To eliminate the accumulation of liquids in the manifold passages 20, a small bleed passage 36 is provided in the lowest portion of the upper passage 20 of each pair. The bleed passage 36 is drilled through the short wall 30 at its lowest point and extends into the lower manifold passage 20 of the pair of passages 20. The bleed passages 36 are small enough to have an insignificant effect on the flow of the fuel-air mixture into the engine, yet are effective to allow any liquid accumulation in the upper passage 20 to flow into the lower manifold passages 20 and on into the engine.

We claim:

1. An induction system for a multi-cylinder two-cycle crankcase compression engine (10) having an even number of cylinders (11) and a generally vertical crankshaft (14), comprising:

(A) a separate crankcase compartment (15) encircling said crankshaft (14) for each cylinder, said compartments (15) arranged in a vertical row;

(B) one inlet opening (22) in each of said crankcase compartments (15), said openings (22) being arranged in a vertical row and each having a rectangular cross section;

(C) one carburetor (17) for each pair of vertically adjacent crankcase inlet openings (22), said carburetors each having a pair of horizontally adjacent barrels (19); and (D) a carburetor adapter means (18) for connecting each barrel (19) of each of said carburetors (17) to one of said crankcase inlet openings (22).

2. The apparatus defined in claim 1 wherein said adapter means (18) has a generally rectangular intake section (25) for each carburetor (17) with each pair of barrels (19) connected to one of said rectangular intake sections (25).

3. The apparatus defined in claim 2 wherein said adapter means (18) has a pair of generally rectangular discharge openings (28) corresponding to each one of said intake sections (25) and connected to said crankcase inlet openings (22).

4. The apparatus defined in claim 3 wherein each of said pairs of discharge openings (28) has a wall (26) separating its discharge openings (28).

5. The apparatus defined in claim 4 wherein each of said walls (26, 30) extends to divide each of said intake sections (25) into a pair of horizontally adjacent openings (27), one for each carburetor barrel (19), to provide a separate passageway (20) from each carburetor barrel (19) to its corresponding crankcase opening (22).

6. The apparatus defined in claim 5 wherein each of said walls (26,30) has a bleed passage connecting the two passageways (20) of a pair to prevent the accumulation of liquids in the upper of said passageways.

7. The apparatus defined in claim 4 wherein the rectangular cross section of each of said charge inlet openings (22) is approximately as long as the diameter of said crankcase compartments (15).

8. The apparatus defined in claim 6 wherein the rectangular cross section of each of said charge inlet openings (22) is approximately as high as the height of said crankcase compartments (15).

9. The apparatus defined in claim 7 wherein said adapter means (18) is die cast in one piece.

* * * * *